United States Patent [19]

Eiselstein et al.

[11] Patent Number: 4,788,036

[45] Date of Patent: Nov. 29, 1988

[54] CORROSION RESISTANT HIGH-STRENGTH NICKEL-BASE ALLOY

[75] Inventors: Herbert L. Eiselstein; Jerry A. Harris; Darrell F. Smith, Jr.; Edward F. Clatworthy, all of Huntington, W. Va.; Stephen Floreen, Schenectedy, N.Y.; Jeffrey M. Davidson, Milburn, N.J.

[73] Assignee: INCO Alloys International, Inc., Huntington, W. Va.

[21] Appl. No.: 914,137

[22] Filed: Oct. 1, 1986

Related U.S. Application Data

[63] Continuation-in-part of Ser. No. 566,601, Dec. 29, 1983, abandoned, which is a continuation-in-part of Ser. No. 255,158, Apr. 17, 1981.

[51] Int. Cl.[4] ..... C22C 19/05

[52] U.S. Cl. ..... 420/448; 148/410; 148/419; 148/427; 148/428; 148/442; 420/451; 420/584

[58] Field of Search ..... 420/448, 451, 584; 148/410, 419, 427, 428, 442

[56] References Cited

U.S. PATENT DOCUMENTS

| | | | |
|---|---|---|---|
| 2,777,766 | 1/1957 | Binder | 75/134 |
| 3,046,108 | 7/1962 | Eiselstein | 420/448 |
| 3,069,258 | 12/1962 | Haynes | 420/448 |
| 3,160,500 | 12/1964 | Eiselstein et al. | 75/171 |
| 3,575,734 | 4/1971 | Muzyka et al. | 148/2 |
| 3,930,904 | 1/1976 | Eiselstein et al. | 148/38 |
| 3,972,713 | 8/1976 | Muzyka et al. | 75/171 |
| 3,972,752 | 8/1976 | Honnorat et al. | 148/162 |
| 4,171,217 | 10/1979 | Asphahani et al. | 75/122 |
| 4,174,213 | 11/1979 | Fukui et al. | 75/134 |

FOREIGN PATENT DOCUMENTS

| | | |
|---|---|---|
| 0056480 | 7/1982 | European Pat. Off. . |
| 1083432 | 9/1967 | United Kingdom . |

OTHER PUBLICATIONS

E. L. Raymond et al, "Effects of Aluminum Content and Heat Treatment on Ga Prime Structure and Yield Strength of INCONEL Nickel-Chromium Alloy 706," Metals & Ceramics Information Center, MCIC Report, MCIC-72-10,N1-N21.

"Metal Progress", Jun., 1979, pp. 100-101.

"Zeitschrift for Metallkunde" (1969), No. 1, pp. 11 to 18 particularly Alloy 4 in Table 1 on p. 11.

K. E. Volk "Nickel and Nickel Alloys" (1970), p. 243.

Japanese Patent Publication 13512/1961.

Japanese Patent Publication 2821/1980.

Morphology of Y' and Y" Precipitates and Thermal Stability of Inconel 718 Type Alloys, R. Cozar and A. Pineau, Metallurgical Transactions, vol. 4, Jan. 73.

Materials Technology for Oil and Gas Production, R. D. Kane & W. K. Boyd Alloys for the 80's, Ann Arbor, MI, Jun. 17-18, 1980, Paper 17.

Alloy Digest, Pyrotool 7, Jan. 1972, Filing Code: Ni--167.

*Primary Examiner*—R. Dean

*Attorney, Agent, or Firm*—Raymond J. Kenny; Francis J. Mulligan

[57] ABSTRACT

Nickel-base alloys containing special and correlated percentages of chromium, iron, molybdenum, titanium, columbium, aluminum etc. (i) provide an attractive combination of strength, ductility, resistance to environmental media and other desirable characteristics, (ii) can be processed by cold working and age hardening to achieve yield strengths of 150,000 psi (1034 MPa) to 200,000 psi (1379 MPa) together with tensile elongations of 10% to 20%, (iii) are resistant to such corrosive media as hydrogen sulphide and acid chloride solutions, and to hydrogen embittlement, and (iv) are useful for, inter alia, petroleum production tubing and sulfur dioxide gas scrubber applications.

19 Claims, 1 Drawing Sheet

CORROSION RESISTANT HIGH-STRENGTH NICKEL-BASE ALLOY

Figure 1:
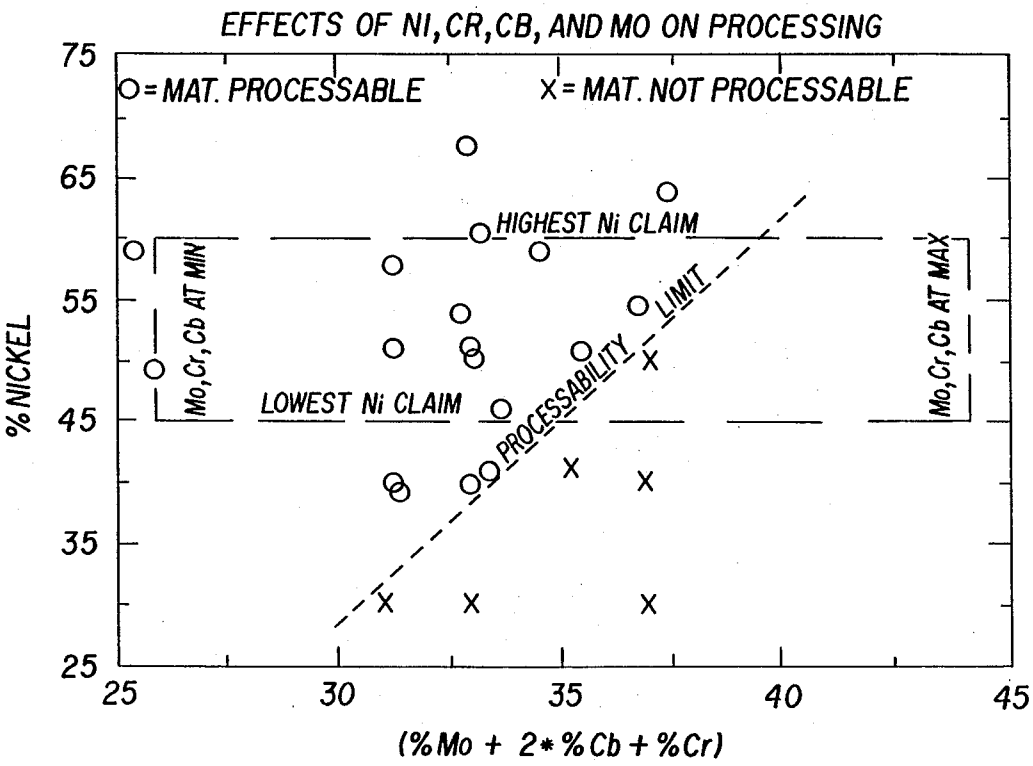

This application is a continuation-in-part of U.S. application Ser. No. 566,601 filed Dec. 29, 1983, abandoned which in turn is a continuation-in-part of U.S. application Ser. No. 255,158 filed Apr. 17, 1981, now withdrawn.

The subject invention is directed to novel nickel-base alloys and articles made therefrom, and particularly to such alloys which offer a desired combination of properties, including high resistance to various corrosive agents while affording high levels of strength, ductility, etc., the alloys being useful in the production of tubing and associated hardware, including packers and hangers, for deep sour gas and/or oil well applications.

FIELD OF INVENTION

There are many industrial and commercial applications requiring alloys that retain strength and other desired characteristics while serving in chemically adverse environments. High strengths, such as yield strengths of 100,000 psi (689.5 megapascals MPa) and higher, advantageously 120,000 or 150,000 psi (1034 MPa) and above, are required for sustaining stress in load-bearing service. And together with stress resistance, some plastic ductility is needed to withstand at least modest amounts of alloy deformation without the occurrence of sudden fracture, thereby, for instance, safeguarding against accidental bending, or enabling cold forming operations to be applied.

Some of the important desiderata for high strength metal articles are for use in contact with chemically subversive corrosives such as chlorides, acids and other hydrogen compounds, e.g., hydrogen sulfide. In terms of a specific and principal area of application to which the subject invention is directed, i.e., gas and/or oil well tubing and associated hardware, e.g., packers, hangers and valves, complex corrosive environments are encountered. For example, hydrogen sulfide attack can occur whereby hydrogen is evolved and should the hydrogen permeate tubing "hydrogen embrittlement" can ensue. Chloride ions can be present in wells and, as a consequence, stress-corrosion cracking is often experienced. And, of course, there is virtually always the troublesome corrosion problem involving pitting brought on by, for example, chloride attack. Thin tubing is often a desideratum but in such cases greater attention has to be focused on the pitting problem. Thus, resistance to pitting, stress-corrosion cracking and hydrogen embrittlement are among the characteristics that are important for certain high-strength metal articles, notably petroleum production tubing and hardware for oil and/or gas wells.

THE INVENTION

Given the foregoing, a new alloy composition has been discovered of controlled proportions in respect of certain elemental constituents notably nickel, chromium, molybdenum, columbium, iron titanium and aluminum, which provides desired levels of high strength, corrosion resistance, durability and other important characteristics, including good fabricability, useful in the production of wrought products and other manufactured articles. Thus, a particular object of the invention, though not limited thereto, is to provide a corrosion-resistant, high-strength, ductile alloy for production of tubing, particularly gas and/or oil well tubing.

EMBODIMENTS OF THE INVENTION

Generally speaking, and in accordance with present invention, the alloy contemplated herein contains by weight, about 15% to 22% chromium, about 10% to 28% iron, about 6% to 9% molybdenum, about 2.5% to 5% columbium, about 1% to 2% titanium, up to about 0.5% aluminum, advantageously 0.05% or about 0.1% to 0.5% aluminum, with the balance being essentially nickel, the nickel constituting 45% to 55% and preferably 50% to 60% of the alloy. Auxiliary elements, including malleablizers and deoxidizers, can be present in small amounts such as: up to 0.1% carbon, up to 0.35% silicon, up to 0.5%, e.g., 0.35%, manganese, up to 0.01% boron, and, also, residual small amounts of cerium, calcium, lanthanum, mischmetal, magnesium, neodymium and zirconium such as may remain from additions totaling up to 0.2% of the furnace charge. Tolerable impurities include up to about 1%, e.g., up to 0.5%, copper, up to 0.015% sulfur and up to 0.015 phosphorous. Up to about 0.15% or 0.2% nitrogen and up to 3% vanadium can be present.

Tungsten and tantalum may be present in incidental percentages, such as are often associated with commercial sources of molybdenum and columbium, respectively e.g., 0.1% tungsten or 0.1% tantalum. Tungsten may be employed in amounts up to 3% in certain instances in lieu of an equivalent percentage of molybdenum. Even so, it is preferred to hold the tungsten level to a low percentage to avoid occurrences of deleterious amounts of undesired phases, e.g., Laves phase, particularly at the higher percentages of chromium, molybdenum and iron. Tantalum can be substituted for columbium in equi-atomic percentages but is not desired in view of its high atomic weight.

In carrying the invention into practice and to derive the benefits conferred by chromium, iron, molybdenum, columbium, titanium, aluminum and nickel, etc. including strength, ductility, corrosion resistance, fabricability and also good durability in the type of corrosive environments above-mentioned, care should be exercised in respect of achieving proper compositional balance. For example, reducing chromium and molybdenum much below the levels above given can result in a needless loss of corrosion resistance. Chromium can be employed up to 25% with enhanced corrosion resistance to be expected. Molybdenum contents down to 5%, though not recommended, can be used, particularly at the higher chromium levels, e.g., 22–25%, and particularly where less aggressive corrosive media are involved.

In striving for optimum corrosion resistance the molybdenum content advantageously should be at least 6.5% and preferably at least 7%, together with a chromium content of at least 20%, the sum of the chromium plus molybdenum preferably being 27% or more. However, this focuses attention on workability. Unless care is exercised there is the risk that objectionable precipitates may form, e.g., Laves phase, in detrimental quantities which, in turn, can lead to cracking during, for example, hot and/or cold rolling to produce sheet and strip. This is particularly true when high percentages of columbium, 4–5% are present together with molybdenum percentages of 7–7.5% or more. It is deemed that columbium exercises a greater adverse impact on workability than does molybdenum. In any case, to counter this undesirable occurrence, it has been found that the nickel content should be at least 52%, and most advantageously 54%, and up to 60%. Moreover, it has been found that such nickel levels markedly contribute to corrosion resistance as reflected by the data in table VIII, infra. In this connection an upper nickel level of 58% is preferred since at 60% strength tends to drop off.

With regard to the percentage of iron, amounts down to 5% can be utilized. It is believed that the higher iron levels, say, above 20% assist in $H_2S$ environments but may detract from resistance to stress corrosion cracking. At the lower iron levels, resistance to stress corrosion cracking is thought improved though resistance to the effects of $H_2S$ may not be quite as good. An iron range of from 5 to 15% is deemed advantageous.

Aluminum, imparts strength and hardness characteristics, but detracts from pitting resistance if present to the excess. Accordingly, it should not exceed about 0.5% and preferably is held below about 0.25 or 0.3%.

While it is preferred that 1% or more titanium be present in the alloys of the instant invention, percentages as low as 0.5% can be employed, particularly in conjunction with columbium at the higher end of its range, say 3.5 or 4% and above. Titanium up to 2.5% can be utilized in the interests of strength.

Where particularly close control is desired, possibly for promoting consistency of desired results, the composition can be specially restricted with one or more of the ranges of 54% to 58% nickel, 18.5% to 20.5% chromium, 13.5% to 18% iron, 6.5% to 8% molybdenum, 3% to 4.5% columbium, 1.3% to 1.7% titanium and 0.05% to 0.5% aluminum.

For achieving advantageously high strength and maintaining good ductility, workability and other desired results, the alloy composition is more closely controlled to have titanium and columbium present in amounts balanced according to the proportioning sum:

%Ti plus ½ (%Cb) equal to at least 3% and no greater than 4%. For instance, about 1.5% titanium and about 4% columbium, such as 1.3% to 1.7% Ti and 3.6% to 4.4% Cb, are advantageous in alloys of the invention.

Given what has been posited above herein, the alloy has good workability, both hot and cold, for production into articles such as wrought products, e.g., hot or cold drawn rod or bar, cold rolled strip and sheet and extruded tubing.

Where desired, the yield and tensile strengths of articles manufactured from the alloy can be enhanced by cold working or age-hardening or combinations thereof, e.g., cold working followed by age-hardening. Heat treatment temperatures for the alloy are, in most instances, about 1600° F. (870° C.) to 2100° F. (1148° C.) for annealing and about 1100° F. (593° C.) to 1400° F. (816° C.) for aging. Direct aging treatments of at 1200° F. (648° C.) to 1400° F. (760° C.) for ½ hour to about 2 or 5 hours directly after cold working are particularly beneficial to obtaining desirable combinations of good strength and ductility.

As indicated, alloys contemplated herein can be hot worked (or warm worked) and then age hardened. Generally speaking, it is thought hot working or warm working followed by aging lends to better resistance to stress corrosion, albeit yield strength is lower. Cold working followed by aging lends to the converse. In this connection, an annealing treatment followed by aging seems to afford better stress corrosion cracking resistance, the yield strength being somewhat lower.

Among the articles of the invention are mechanithermo processed high-strength, corrosion-resistant products characterized by yield strengths (at 0.2% offset) upwards of 120,00 to 150,000 psi (pounds per square inch) (1034 MPa) and elongations of 8%, and higher, e.g., 160,000, 180,000 or 190,000 psi (1103, 1241 or 1310 MPa) and 10, 12 or 15% and even greater strengths and elongations.

For purposes of giving those skilled in the art a better understanding of the invention, the following illustrative examples and data are given.

EXAMPLE I

A furnace charge of metal in weight percent of 50Ni/20Cr/18Fe/7Mo)3Cb/1.5Ti/0.1Al/0.03Mg was vacuum induction melted and cast-to-ingot form, the chemical analysis thereof (Alloy 1) and of certain other alloys of the invention, being set forth in Table I.

Ingots of alloy 1 were heated at 2050° F. (1122° C.) (for) 16 hours for homogenization and then forged flat from 2050° F. (1122° C.). Flats were hot rolled at 2050° F. (1122° C.) to reduce to 0.16 gage (about 4 mm), annealed 1950° F. (1066° C.)/1 hr and cold rolled to 0.1 gage (about 2.5 mm) strip, which was again annealed 1950° F. (1066° C.)/1 hr. Specimens of the annealed 0.1 gage strip were cold rolled different amounts to make 0.062, 0.071 and 0.083 gage (1.57, 1.8 and 2.11 mm) sizes and then each size (including the 0.1 gage was again annealed 1950° F. (1066° C.)/1 hr and cold rolled down to final gage of 0.05 (about 1.27 mm), resulting in cold work reductions of about 20%, 30%, 40% and 50%.

Hardenability data, including work hardenability and age hardenability, for Alloy 1 are given in Table II, on specimens of the 0.05 gage strip before and after heat treatments with temperatures and times referred to in Schedule HT infra.

Tensile specimens (0.05 gage strip) of Alloy 1 were evaluated for mechanical properties at room temperature in preselected mechanithermo processed conditions, including the as cold-rolled and cold-rolled plus heat treated conditions, the results being set forth in Table III. It is notable that with cold-worked embodiments of the alloy of the invention, "direct aging", whereby the alloy is heat treated at age-hardening temperature directly (without other heat treatment intervening between cold working and aging) following cold working, resulted in yield strengths of 150,000 psi (1034 MPa) and higher, with good retention of ductility. Moreover, the 1200° F. (649° C.) direct age provided in unusually advantageous increase in both strength and ductility, strength and ductility exceeding 160,000 psi (1103 MPa) and 20% elongation, respectively.

No significant loss in ductility was experienced under a variety of processed conditions when Alloy 1 was subjected to hydrogen charging in connection with one-inch wide (25.4 mm) cold-formed U-bend specimens that were held restrained at stresses greater than 100% of yield stress while being cathodically charged in a 5% sulfuric acid solution at 10 milliamps total current for 500-hour periods. Successful survival (retained ductility) throughout the 500-hour charging periods was shown with Alloy 1 in twelve processing treatment conditions, as given below, ACR 20%, 30% 40% and 50%;
HT-1 following 20%, 30%, 40% and 50% CR;
20% CR plus HT-8; 20% CR plus HT-9;
20% CR plus HT-10; 20% CR plus HT-11.

In contrast, two restrained U-bend specimens of 20% cold rolled strip of Alloy 1 in conditions resulting from long-time (in these instances, over 16 hours) direct age treatments HT-5 and HT-6 failed after unsatisfactorily brief survivals of 5 hours and 2 hours, respectively, when subjected to the same hydrogen charging conditions.

Composition is deemed important to the success of processed articles of the invention in, inter alia, resisting hydrogen embrittlement inasmuch as during comparable hydrogen-charging U-bend evaluations with alloy compositions differing from Alloy 1, e.g., with different iron and/or molybdenum percentages, failures occurred after unsatisfactorily short time periods, even though cold rolling and heat treatments that had been shown satisfactory with Alloy 1 had been applied.

Good resistance to contact with acid chloride media at elevated temperatures was confirmed by weight loss and visual appearance determinations of 4"×3" (10.2 cm×7.62 cm) specimens of Alloy 1 in the 40% cold-rolled condition. Two specimens were immersed in aqueous 10% $FeCl_3$+0.5% HCl solutions at 150° F. (66° C.) for 24 hours. The weight losses were satisfactorily low, being 0.03 and 0.52 milligrams per square centimeter. Visual inspection showed that only one pit occurred and confirmed that the alloy metal provided good resistance to the acid media. Additional pitting data are given in Table V.

The capability of Alloy 1 to provide resistance against stress-corrosion cracking was shown by satisfactory survival of a 50% cold rolled restrained, U-bend specimen during a 720-hour exposure in boiling 42% $MgCl_2$.

EXAMPLE II

A furnace charge of virgin-metal constituents for a nickel-base alloy containing about 18¾%Cr/14%Fe/6½%Mo/4¼%Cb/1½%Ti/balance nickel and lesser amounts of aluminum and other elements in accordance with the invention was air-induction melted and centrifugally cast under protection of an argon shroud, in a metal mold with 4¼" (10.8 cm) I.D. (inside diameter) and 1300 rpm rotation speed. This resulted in a cast, centrifugally solidified, tube shell of Alloy 2. Cast dimensions were about 4¼" O.D. and about ¾" (1.9 cm) wall thickness. For further processing, the cast shell was "cleaned-up" to a size of about 4" (10.2 cm) O.D. with about 0.437" (1.11 cm) wall.

A leader tube was welded onto the shell and processing proceeded as follows. The tube shell was annealed at 2100° F. (1149° C.), pickled and cold drawn (about 15.8%) to 3.75" (9.252 cm) O.D.×0.39" (0.99 cm) wall re-annealed at 2100° F. (1149° C.) and pickled, then cold drawn to 3.5" (8.89 cm) O.D.×0.35" (0.990 cm) wall (also 15.8% reduction), re-annealed at 2100° F. (1149° C.) and pickled, then tube reduced to 2.625" (6.668 cm) O.D.×0.3" (0.762 cm) wall (about 36.7% reduction in area).

Mechanical properties determined with sub-size round-bar specimens taken longitudinally from the tube wall are reported in Table IV.

EXAMPLE III

A cylindrical tube of another alloy (Alloy 3, Table I) of the invention was made using a furnace charge for a nickel-based alloy with about 20%Cr/17%Fe/7%Mo/3%Cb/1½%Ti/balance nickel and lesser amounts of aluminum and other elements according to the invention. The melting, casting and other forming practices of Example II were again employed and cold-worked tube of Alloy 3 was produced. Mechanical property determinations are set forth in Table IV.

The results reflect that very good combinations of strength and ductility were achieved with cold worked-and-direct aged articles of Alloys 2 and 3, especially with one to two hour direct aging at 1300° F. (704° C.) to 1400° F. (760° C.).

A transverse specimen taken from the extruded and 1300° F. (704° C.) directed aged product of Alloy 3 was of ASTM grain size No. 3½; optical microscopy of the specimen showed an absence of intergranular carbides and indicated that the extruded, cold-reduced and heat treated microstructure did not contain any intra-granular phases resolvable at 1000×.

EXAMPLE IV

To further examine stress corrosion behavior, an alloy (Alloy 4) was vacuum melted and cast as a 30 lb. ingot, the chemical composition being 18.4%Cr/8%Mo/17.6%Fe/0.19%Al/1.3%Ti/3.2%Cb/0.016%C and the balance essentially nickel. The ingot was hot rolled to ⅝" thick plate stock at 2100° F. (1149° C.). Specimens of the plate stock were then aged 8 hrs. at 1325° F. (718° C.), furnace cooled at 100° F. (44° C.)/1 hr. to 1150° F. (621° C.) and held there at for 10 hrs. followed by air cooling.

Tensile testing showed this material had a yield strength of 169 ksi with 22% elongation.

U-bend samples of Alloy 4 galvanically coupled to steel were tested in the NACE $H_2S$ environment, i.e., a solution of 5 grams glacial acetic acid, 50 grams NaCl, 945 grams water, saturated with $H_2S$ gas (NACE Spec Standard TM-01-77). No failures were observed after 6 weeks exposure.

Table V reflects that high aluminum levels can adversely impact pitting resistance. The testing involved immersing alloy specimens in 6% ferric chloride solution at 122° F. (50° C.) using an exposure period of 72 hrs. (While this test does not duplicate service conditions in a sour gas well, it has been reported that there is a reasonably good correlation between pitting behavior in this ferric chloride solution and other test environments that more closely simulate deep sour gas well environments.) Specimens were treated in the age-hardened condition, i.e., 2100° F. (1149° C.) anneal for ½ hour, water quenching, age at 1600° F. (871° C.) for 4 hours followed by a water quench.

While alloys A, B and C have low titanium contents, titanium does not have a detrimental affect on pitting resistance; thus, it is deemed these alloys are satisfactory for comparison purposes. Alloy A is probably not as poor as the data suggests. Alloy 5 was given five additional heat treatments and the results were virtually the same as that reported in Table V.

Additional tests were conducted in 10% ferric chloride at 152° F. (67° C.) for an exposure period of 24 hours to determine the corrosion sensitivity of the invention alloy versus aluminum content. The analyzed chemistries for Alloys 6, 7, D and E and results are given in Table VI, the alloys (0.15 inch thick×3 inches wide×4 inches long) being in the cold-rolled (20%) plus 1400° F. (760° C.) 12 hours, air-cooled condition. The results are consistent with the data in Table V, i.e., high aluminum is deleterious. Other tests were conducted with Alloys 6, 7, D and E for a different heat treatment but the results were considered unreliable, this being attributed to surface defects.

As indicated earlier on, excessive molybdenum and columbium contents can introduce unnecessary risks in terms of Laves phase formation, particularly with low nickel percentages. This is reflected by the data in Table VII concerning the hot rolling of 0.500 inch plate to 0.160 inch strip at 2050° F. As also indicated above herein, nickel, apart from inhibiting formation of the laves phase, imparts a high level of resistance to corrosion as shown in Table VIII.

The balance of the major constituents nickel, molybdenum, chromium, columbium and iron must be carefully controlled within the previously stated limits if alloys of the invention are to be fabricable by hot working operations. To ensure good hot fabricability the nickel content should be increased as chromium, molybdenum and columbium are increased. Compared to chromium and molybdenum, columbium is a particular deterrent to workability. The following relationship (A) among these elements has been determined defining the minimum Ni required to impart good hot workability in these alloys: $Ni \geqq 3.3\ (Mo+Cr+2Cb)-71$. This relationship is graphically depicted in FIG. 1.

Alloys satisfying the foregoing relationship can be hot worked but may still exhibit low ductility during subsequent processing to desired end product forms or during tensile testing of the final product and equation (B) below are accurately predicts compositions which may exhibit such low ductility as to be commercially unattractive by predicting the relative abundance of deleterious Laves phase $$LN\ (\%\ Laves) = -2.408 - 0.01881\ (\%Ni \times \%Cb) + 0.00929\ (\%Fe \times \%\ Mo) + 0.2075\ (\%Mo \times \%\ Cb)$$

In general those compositions predicting greater than about 5% Laves will likely exhibit marginal cold workability and, further, compositions should be provided below about 2.5% predicted Laves to ensure adequate tensile ductility.

By way of example, Alloy M which predicts about 9.9% Laves, while negotiating hot working, could not be cold worked at levels of 40% or greater without cracking. Another composition, Alloy H, predicting 5.3% Laves was cold workable up to 50% reduction but only retained 1.5% tensile elongation when tested at room temperature.

Concerning the pitting data in Table VIII specimens were immersed in a $FeCl_3FeCl6H_2O$+0.1% HCl solution maintained at 150° F. for 24 hours. As will be observed, a nickel content of 40% was insufficient to inhibit attack notwithstanding a 9% molybdenum level (Alloy 9). When the nickel content was raised to 50% and 60% (Alloy N and 9) virtually no pitting was encountered. The 7% molybdenum Alloys 8 and 7 behaved in similar fashion. Molybdenum at 5% was simply too low irrespective of nickel content, Alloys G, 9 and 10.

The present invention is applicable to providing metal articles; e.g., tubes, vessels, casings and supports, needed for sustaining heavy loads and shocks in rough service while exposed to corrosive media, and is particularly applicable in the providing of production tubing and associated hardware, such as packers and hangers, to tap deep natural reservoirs of hydrocarbon fuels. In deep oil or gas well service, possibly in off-shore installations, the invention is especially beneficial for resistance to media such as hydrogen sulfide carbon dioxide, organic acids and concentrated brine solutions sometimes present with petroleum. Also, the invention is applicable to providing good resistance to corrosion in sulfur dioxide gas scrubbers and is considered useful for seals, ducting fans, and stack liners in such environments. Articles of the alloy can provide useful strength at elevated temperatures up to 1200° F. (648° C.) and possibly higher.

For purposes of this specification and claims, both English and Metric units have been used. Original observations were obtained in English units, Metric units being obtained by conversion. If any discrepancy exists between these units, the English units shall control.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention appended claims.

TABLE I

| | CHEMICAL ANALYSES, WEIGHT PERCENTS | | | | | | | | | | | | |
|---|---|---|---|---|---|---|---|---|---|---|---|---|---|
| Alloy | Cr | Fe | Mo | Cb | Ti | Al | C | Mn | Si | B | Cu | Mg | Ni |
| 1 | 20.09 | 17.55 | 7.06 | 3.02 | 1.49 | 0.13 | 0.03 | 0.18 | 0.26 | 0.006 | NA | 0.011 | 50.23 |
| 2 | 18.73 | 13.89 | 6.60 | 4.29 | 1.45 | 0.35 | 0.02 | 0.29 | 0.19 | 0.007 | 0.26 | 0.021 | 53.91 |
| 3 | 19.89 | 16.61 | 7.18 | 3.10 | 1.51 | 0.08 | 0.03 | 0.22 | 0.16 | 0.006 | 0.06 | 0.016 | 51.14 |

NA — Not Analyzed
Cobalt, phosphorous and sulfur, when analyzed, were found present in percentages of 0.011% or lower.
Columbium percentages include possible small proportions of tantalum.

TABLE II

| | Rockwell C Hardnesses | | | |
|---|---|---|---|---|
| Condition | 20% CR | 30% CR | 40% CR | 50% CR |
| ACR | 35 | 38 | 38.5 | 40 |
| CR + HT-1 | 40 | 40 | 40 | 40.5 |
| CR + HT-2 | 40.5 | 40.5 | 41.5 | 41.5 |
| CR + HT-3 | 37 | 40.5 | 41.5 | 42.5 |
| CR + HT-4 | 42 | 44 | 44 | 45 |
| CR + HT-5 | 45 | 47 | 47 | 44.5 |
| CR + HT-7 | 39.5 | — | — | — |
| CR + HT-8 | 41 | — | — | — |
| CR + HT-9 | 39.5 | — | — | — |
| CR + HT-10 | 31.5 | — | — | — |
| CR + HT-11 | 37 | — | — | — |

ACR — As Cold Rolled
% CR — percent reduction of thickness by cold rolling (after last anneal)
Annealed hardnesses of 20% CR strip were, by Rockwell B scale, 97, 93 and 78 after treatments of 1750° F. (954° C.)/(½)hr, 1900° F. (1038° C.)/1 hr and 2100° F. (1149° C.)/(½) hr; corresponding results with 40% CR strip were 23.5Rc, 94Rb and 78Rb.

| SCHEDULE HT | |
|---|---|
| HT-1 | 1900° F.(1038° C.)/0.5,AC + 1400° F. (760° C.)/8-FC-1200° F.(648° C.)/8,AC (heated at 1900° F.(1038° C.) for one-half hour, then air cooled to room |

-continued

| SCHEDULE HT | |
|---|---|
| | temperature, plus heating at 1400° F. (760° C.) for 8 hours followed by furnace cooling to 1200° F. (649° C.) and holding there for 8 hours and then air cooling to room temperature.) |
| HT-2 | 1750° F.(954° C.)/0.5,AC + 1325° F.(718° C.)/8-FC-1150° F.(622° C.)/8,AC |
| HT-3 | 1150° F.(622° C.)/1,AC |
| HT-4 | 1400° F.(760° C.)/1,AC |
| HT-5 | 1325° F.(718° C.)/8-FC-1150° F.(622° C.)/8,AC |
| HT-6 | 1400° F.(760° C.)/8-FC-1200° F.(648° C.)/8,AC |
| HT-7 | 1200° F.(648° C.)/5,AC |
| HT-8 | 1300° F.(704° C.)/5,AC |
| HT-9 | 1400° F.(760° C.)/5,AC |
| HT-10 | 2100° F.(1148° C.)/0.5,AC + HT-5 |
| HT-11 | 2100° F.(1148° C.)/0.5,AC + HT-6 |

TABLE III

| Condition | Alloy 1 YS, KSI(MPa) | UTS, KSI(MPa) | % Elongation (1-inch)(2.54 cm) |
|---|---|---|---|
| ACR-20% | 148.3(1022) | 162.6(1121) | 15.5 |
| ACR-30% | 176.3(1215) | 186.1(1283) | 3.5 |
| ACR-40% | 184.0(1268) | 190.3(1312) | 4.5 |
| ACR-50% | 196.1(1352) | 197.0(1358) | 3.5 |
| 20% CR + HT-7 | 163.4(1127) | 187.5(1293) | 21.0 |
| 20% CR + HT-8 | 161.7(1115) | 188.3(1298) | 15.0 |
| 20% CR + HT-9 | 154.2(1063) | 188.0(1296) | 14.0 |

YS — Yield Strength at 0.2% offset
UTS — Ultimate Tensile Strength
KSI — kips (1000 pound) per square inch

TABLE IV

| Condition | YS, KSI (MPa) | UTS, KSI (MPa) | % Elong (1") | % R.A. | Hardness (Rc) |
|---|---|---|---|---|---|
| Alloy 2 | | | | | |
| 36.7% TR +– | 158.2 (1091) | 167.8 (1157) | 22.0 | 51.0 | 30 |
| 36.7% TR + 1300° F. (705° C.)/1,AC | 193.5 (1334) | 198.0 (1365) | 13.5 | 39.8 | 38 |
| 36.7% TR + 1300° F. (705° C.)/2,AC | 201.9 (1392) | 208.6 (1438) | 14.5 | 42.0 | 40 |
| 36.7% TR + 1400° F. (760° C.)/1,AC | 198.5 (1369) | 205.2 (1415) | 12.6 | 33.4 | 39 |
| 36.7% TR + 1400° F. (760° C.)/2,AC | 201.6 (1390) | 206.2 (1422) | 12.5 | 33.9 | 40 |
| 36.7% TR + 1900° F. | 151.5 (1045) | 195.9 (1351) | 31.6 | 50.5 | 34 |

TABLE IV-continued

| Condition | YS, KSI (MPa) | UTS, KSI (MPa) | % Elong (1") | % R.A. | Hardness (Rc) |
|---|---|---|---|---|---|
| (1038° C.)/1,AC + HT-5 | | | | | |
| Alloy 3 | | | | | |
| 36.7% TR + | 151.1 (1042) | 162.3 (1119) | 17.5 | 53.8 | 30 |
| 36.7% TR + 1300° F. (705° C.)/1,AC | 179.0 (1234) | 191.7 (1322) | 16.5 | 44.2 | 36 |
| 36.7% TR + 1300° F. (705° C.)/2,AC | 182.0 (1255) | 194.6 (1342) | 15.0 | 48.5 | 37 |
| 36.7% TR + 1400° F. (760° C.)/1,AC | 180.5 (1245) | 190.5 (1313) | 13.6 | 39.9 | 37.5 |
| 36.7% TR + 1400° F. (760° C.)/2,AC | 185.4 (1278) | 195.6 (1329) | 13.5 | 31.4 | 37.5 |
| 36.7% TR + 1900° F. (1038° C.)/1,AC + HT-5 | 134.0 (924) | 186.6 (1287) | 28.6 | 49.2 | 32.0 |

R.A. — Reduction in Area

TABLE V

| Alloy | Cr | Fe | Mo | Cb | Ti | C | Al | Ni | weight loss mg/cm$^2$ |
|---|---|---|---|---|---|---|---|---|---|
| 4 | 19.0 | 14.2 | 7.9 | 2.9 | 1.20 | 0.080 | 0.08 | Bal** | 0 |
| A | 20.1 | 14.6 | 7.9 | 3.0 | 0.07 | 0.082 | 0.96 | " | 2557 |
| B | 18.8 | 11.8 | 7.9 | 3.1 | 0.11 | 0.007 | 0.11 | " | 0.4 |
| C | 20.0 | 14.6 | 7.8 | 3.0 | 0.08 | 0.064 | 0.41 | " | 0.004 |
| 5* | 18.0 | 13.6 | 8.3 | 2.9 | 1.50 | 0.066 | 0.25 | " | 0.227 |

*aged at 1400° F. (704° C.) for 1 hour and air-cooled
**Bal = balance plus minor amounts of manganese, silicon, etc.

TABLE VI

| Alloy | Cr | Fe | Mo | Cb | Ti | C | Al | Ni | weight loss mg/cm$^2$ |
|---|---|---|---|---|---|---|---|---|---|
| 6 | 17.8 | 14.84 | 6.41 | 3.62 | 1.50 | 0.008 | 0.07 | 54.8 | 4.15 |
| 7 | 18.8 | 13.06 | 6.51 | 3.68 | 1.61 | 0.012 | 0.27 | 55.4 | 8.04 |
| D | 18.8 | 12.14 | 6.63 | 3.75 | 1.73 | 0.009 | 0.67 | 55.8 | 11.9 |
| E | 18.1 | 11.95 | 6.72 | 3.83 | 1.72 | 0.010 | 0.98 | 55.9 | 82.6 |

TABLE VII

| Alloy | Cr | Fe | Mo | Cb | Mo + Cb | Ti | C | Al | Ni | Hot Worked |
|---|---|---|---|---|---|---|---|---|---|---|
| F | (20) | (38) | (7) | (3) | (10) | (1.5) | (0.2) | (.10) | (30) | C, Laves |
| G | 20.06 | 30.55 | 5.18 | 3.06 | 8.24 | .55 | .067 | .62 | 39.42 | P |
| H | 19.88 | 28.26 | 7.1 | 3.05 | 10.15 | 1.52 | .02 | .14 | 39.77 | P |
| I | (20) | 26 | (7) | (5) | (12) | (1.5) | .02 | (.10) | (40) | C, Laves |
| J | (20) | (16) | (7) | (5) | (12) | (1.5) | (.02) | (.10) | (50) | C, Laves |
| K | 19.88 | 1.69 | 7.19 | 5.19 | 12.38 | 1.51 | .02 | .24 | 63.88 | P |
| L | 19.91 | 21.20 | 9.28 | 2.16 | 11.44 | 1.07 | .02 | .14 | 45.91 | P |
| M | 20.03 | 26.23 | 9.34 | 2.11 | 11.45 | 1.07 | .02 | .14 | 40.87 | P |
| N | 19.99 | 15.99 | 9.21 | 2.12 | 11.34 | 1.09 | .02 | .10 | 51.24 | P |
| O | 20.26 | 6.85 | 8.79 | 2.09 | 10.88 | 1.02 | .02 | .10 | 60.44 | P |
| 8 | 20.09 | 17.55 | 7.06 | 3.02 | 10.08 | 1.49 | .03 | .13 | 50.23 | P |
| 9 | 14.81 | 25.91 | 5.14 | 2.98 | 8.12 | .54 | .039 | .63 | 49.31 | P |
| 10 | 14.44 | 16.29 | 5.08 | 3.09 | 8.17 | .54 | .020 | .59 | 59.05 | P |

P = Pass
C = Cracked
( ) = nominal

TABLE VIII

| Alloy | % Nickel (nominal) | % Molybdenum (nominal) | Pitting Behavior Wt. Loss, mg/cm$^2$ |
|---|---|---|---|
| G | 40 | 5 | 42.5 |
| H | 40 | 7 | 38.2 |
| M | 40 | 9 | 37.3 |
| 9 | 50 | 5 | 37.9 |
| 8 | 50 | 7 | 0.2 |
| N | 50 | 9 | 0.54 |
| 10 | 60 | 5 | 45.5 |
| K | 64 | 7 | .02 |
| 0 | 60 | 9 | .03 |

We claim:

1. A nickel-base alloy characterized by good workability and fabricability and further characterized in both the cold-rolled and aged conditions by high strength, good ductility and resistance to pitting, hydrogen embrittlement and stress-corrosion cracking said alloy consisting essentially of, in weight percent, about 15 to 25% chromium, about 5 to about 15% iron, about 6.5 to 9% molybdenum, about 2.5 to 5% columbium, from 0.5 to 2.5% titanium with the proviso that when the titanium is less than 1% the columbium is at least 3.5%, up to about 0.5% aluminum and the balance nickel with nickel constituting about 50 to about 60% of the alloy.

2. An alloy as set forth in claim 1 wherein the nickel content is at least about 52%, the chromium content is at least about 18.5%, the molybdenum and columbium are correlated such that when the molybdenum content exceeds about 7% the columbium content is not greater than about 4%, the titanium is about 1 to 2.5%, and any Laves phase does not exceed about 5% as determined by the following relationship:

$$LN(\%Laves) = -2.408 - 0.01881\ (\%Ni \times \%Cb) + 0.00929\ (\%Fe \times \%Mo) + 0.2075\ (\%Mo \times \%Cb).$$

3. An alloy set forth in claim 2 wherein the nickel is about 54 to 58%, the chromium is about 18.5 and up to about 22%, the molybdenum is at least 7%, the sum of the chromium plus molybdenum is at least about 27%, the titanium content is from 1 to 2%, the columbium content is 3 to 4.5% and the sum of the molybdenum plus columbium is at least 10%.

4. An alloy as set forth in claim 3 in which the percentages of titanium and columbium are correlated in accordance with the relationship of $\%Ti + \frac{1}{2}\%Cb$ is equal to at least 3% but is not greater than 4% and aluminum is about 0.05 to 0.3%.

5. An alloy as set forth in claim 2 in which the presence of any carbon, silicon, manganese and boron does not exceed about 0.1% carbon, about 0.35% silicon, about 0.5% manganese and about 0.01% boron.

6. An alloy as set forth in claim 1 in which any Laves phase does not exceed about 5% as determined by the following relationship:

$$LN\ (\%Laves) = -2.408 - 0.01881\ (\%Ni \times \%Cb) + 0.00929\ (\%Fe \times \%Mo) + 0.2075\ (\%Mo \times \%Cb)$$

and wherein the nickel, molybdenum, chromium and columbium are correlated to satisfy the following relationship:

$$\%\ Ni\ 3.3\ (\%Mo + \%Cr + 2Cb) - 71.$$

7. As an article of manufacture, a product selected from gas and/or oil well tubing, packers, hangers and valves and formed from the alloy set forth in claim 3.

8. A nickel-chromium-iron base alloy characterized by good workability and fabricability and further characterized in the aged condition by high strength, good ductility and resistance to pitting, hydrogen embrittlement and stress-corrosion cracking, said alloy consisting essentially of about 15% to 22% chromium, about 10% to 28% iron, about 6% to 9% molybdenum, about 2.5% to 5% columbium, about 1% to about 2% titanium, about 0.05% to about 0.5% aluminum and the balance essentially nickel in a weight proportion of about 45% to about 55% of said alloy, said alloy being devoid of deleterious Laves phase.

9. An alloy as set forth in claim 8 wherein the amounts of titanium and columbium are in accordance with the relationship of Ti plus $\frac{1}{2}$ (%Cb) equal at least 3% and no greater than 4%.

10. An alloy as set forth in claim 8 wherein the presence of carbon, silicon, manganese and boron is restricted not to exceed 0.1% carbon, 0.35% silicon, 0.35% manganese, and 0.01% boron.

11. An alloy as set forth in claim 9 containing 18.5% to 20.5% chromium, 13.5% to 18% iron and 6.5% to 7.5% molybdenum and about 1.3 to 1.7% titanium.

12. A cold worked metal article comprising the alloy set forth in claim 8.

13. A manufactured metal article comprising the alloy set forth in claim 8 in the condition resulting from cold working and aging the alloy at a temperature of about 1100° F. to 1500° F. and characterized by a yield strength of at least about 150,000 psi and an elongation of at least about 8%.

14. As a new article of manufacture, an oil or gas well tube for use in deep sour gas or oil wells and formed from the alloy set forth in claim 9.

15. A nickel-chromium-iron base alloy characterized by good workability and fabricability and further characterized in the aged condition by high strength, good ductility and resistance in pitting, hydrogen embrittlement and stress-corrosion cracking, said alloy consisting essentially of from 15% to about 25% chromium, about 5% to about 15% iron, about 6.5% to 9% molybdenum, about 2.5 to 5% columbium, from 0.5 to 2.5% titanium, with the proviso that when the titanium is below 1% the columbium is at least 3.5%, up to about 0.5% aluminum and the balance nickel, the nickel being from about 45% to about 55% of said alloy.

16. The alloy set forth in claim 15 and containing about 18.5 to 25% chromium, about 2.5 to 4.5% columbium, and being devoid of detrimental Laves phase.

17. The alloy set forth in claim 16 and containing up to about 0.25% aluminum.

18. As a new article of manufacture, a product selected from oil and/or gas well tubing, packers, hangers and valves and formed from the alloy set forth in claim 16.

19. A nickel-base alloy characterized by good workability and fabricability and further characterized in both the cold-rolled and aged conditions by high strength, good ductility and resistance to pitting, hydrogen embrittlement and stress corrosion cracking, said alloy consisting essentially of, in weight percent, about 18.5 to about 22% chromium, from 5 to 15% iron, from 6.5 to 9% molybdenum, from 3 to 4.5% columbium, the molybdenum and columbium being correlated such that when the molybdenum exceeds 7% the columbium is not greater than about 4%, about 1 to 2.5% titanium, up to 0.5% aluminum and about 52 to less than 60% nickel in which the nickel, molybdenum, chromium and columbium are correlated to satisfy the following relationship:

$$\% \text{ Ni} \geqq 3.3(\% \text{ Mo} + \% \text{ Cr} + 2\% \text{ Cb}) - 71$$

and in which any Laves phase does not exceed about 5% as determined by the following relationship:

$$\text{LN } (\% \text{ Laves}) = -2.408 - 0.01881 (\% \text{ Ni} + \% \text{ Cb}) + 0.00929 (\% \text{ Fe} \times \% \text{ Mo}) + 0.2075 (\% \text{ Mo} \times \% \text{ Cb}).$$

* * * * *